US011482392B2

(12) United States Patent
Han

(10) Patent No.: US 11,482,392 B2
(45) Date of Patent: Oct. 25, 2022

(54) ELECTROMAGNETIC TRIP UNIT

(71) Applicant: Schneider Electric Industries SAS, Rueil-Malmaison (FR)

(72) Inventor: Zhigang Han, Shanghai (CN)

(73) Assignee: Schneider Electric Industries SAS, Rueil Malmaison (FR)

( * ) Notice: Subject to any disclaimer, the term of this patent is extended or adjusted under 35 U.S.C. 154(b) by 324 days.

(21) Appl. No.: 16/511,439

(22) Filed: Jul. 15, 2019

(65) Prior Publication Data

US 2020/0027680 A1 Jan. 23, 2020

(30) Foreign Application Priority Data

Jul. 20, 2018 (CN) ..... 201810805205.5

(51) Int. Cl.
*H01H 71/34* (2006.01)
*H01H 71/04* (2006.01)
(Continued)

(52) U.S. Cl.
CPC ..... *H01H 71/345* (2013.01); *H01H 50/44* (2013.01); *H01H 71/04* (2013.01);
(Continued)

(58) Field of Classification Search
CPC ..... H01H 71/7463; H01H 2050/446; H01H 2069/013; H01H 2071/2427; H01H 50/44;
(Continued)

(56) References Cited

U.S. PATENT DOCUMENTS 4,939,492 A * 7/1990 Raso ..... H01H 71/2454 335/124
5,066,980 A * 11/1991 Schweizer ..... H01F 7/13 335/255
(Continued)

FOREIGN PATENT DOCUMENTS

CN 204375664 U 6/2015
CN 205789815 U 12/2016
CN 107516622 A 12/2017

OTHER PUBLICATIONS

Chinese Office Action dated Apr. 6, 2021 corresponding to Chinese Patent Application No. 201810805205.5, with English translation, 18 pages.
(Continued)

*Primary Examiner* — Bernard Rojas
(74) *Attorney, Agent, or Firm* — Locke Lord LLP

(57) ABSTRACT

An electromagnetic trip unit, wherein: the electromagnetic trip unit includes a movable core, an upper static core and a lower static core; the movable core can move relative to the upper static core and the lower static core in the upper static core and the lower static core; a movable core body end of a movable core body of the movable core faces and approaches the lower static core end of the lower static core, when the electromagnetic trip unit is not released, a first magnetic field air gap is formed between the movable core body end and the lower static core end; the movable core body of the movable core is also provided with a movable core body step, when the electromagnetic trip unit is not released, a second magnetic field air gap is formed between the movable core body step and the lower static core end.

17 Claims, 14 Drawing Sheets

(51) Int. Cl.

| | |
|---|---|
| ***H01H 71/24*** | (2006.01) |
| ***H01H 71/52*** | (2006.01) |
| ***H01H 71/74*** | (2006.01) |
| ***H01H 50/44*** | (2006.01) |

(52) U.S. Cl.
CPC ..... *H01H 71/2472* (2013.01); *H01H 71/52* (2013.01); *H01H 71/7463* (2013.01); *H01H 2050/446* (2013.01); *H01H 2071/2427* (2013.01)

(58) Field of Classification Search
CPC .... H01H 69/01; H01H 71/04; H01H 71/2463; H01H 71/2472; H01H 71/345; H01H 71/52; H01H 71/24
See application file for complete search history.

(56) References Cited

U.S. PATENT DOCUMENTS

| | | | | |
|---|---|---|---|---|
| 5,467,069 | A * | 11/1995 | Payet-Burin | H01H 71/7463 335/10 |
| 7,280,021 | B2 * | 10/2007 | Nagasaki | H01F 7/13 335/227 |
| 8,476,998 | B2 * | 7/2013 | Ramirez | H01H 71/2463 335/172 |
| 2016/0181049 | A1 * | 6/2016 | Rallabandi | H01F 7/0278 335/38 |

OTHER PUBLICATIONS

Patent Office of the Republic of Poland Office Action dated Sep. 29, 2020 for Polish Application No. 430669, with English Language Translation, 6 pages.

* cited by examiner

ELECTROMAGNETIC TRIP UNIT

TECHNICAL FIELD

The present disclosure relates to an electromagnetic trip unit, and more particularly to a solenoid type electromagnetic trip unit having a two-stage adjustable magnetic field air gap.

BACKGROUND TECHNOLOGY

In the prior art, the purpose of adjusting the instantaneous setting current is generally achieved by adjusting the magnetic field air gap between the movable core and the static core in a solenoid type electromagnetic trip unit. Since the current threshold of the circuit breaker protection in a specific market requirement is very low, the existing technology is often implemented by increasing the number of turns of the coil, so that the product cost is high.

SUMMARY OF THE INVENTION

The present disclosure mainly realizes two-stage adjustable magnetic field air gap by changing the movable core, thereby realizing the selection of different current thresholds, while other parts remain unchanged.

In order to solve the above-mentioned defects in the prior art, an electromagnetic trip unit is provided based on a first aspect of the present disclosure, wherein said the electromagnetic trip unit comprises a movable core, an upper static core and a lower static core. The movable core can move relative to the upper static core and the lower static core in the upper static core and the lower static core. A movable core body end of a movable core body of the movable core faces and approaches the lower static core end of the lower static core. When the electromagnetic trip unit is not released, a first magnetic field air gap is formed between the movable core body end and the lower static core end.

The electromagnetic trip unit also includes a magnetic field air gap adjusting assembly which is connected with the movable core and the movement of the magnetic air gap adjusting assembly causes the movable core to move so as to adjust the first magnetic field air gap.

The movable core body of the movable core is also provided with a movable core body step. When the electromagnetic trip unit is not released, a second magnetic field air gap is formed between the movable core body step and the lower static core end.

The first magnetic field air gap is smaller than the second magnetic field air gap.

The magnetic field air gap adjusting assembly includes a trip lever, which can rotate around a longitudinal axis of the trip lever and move along the longitudinal axis of the trip lever; and a rocker arm assembly, which is connected to the movable core and can rotate around an axis of the rocker arm assembly; the linear motion of the trip lever drives the rotation of the rocker arm assembly, thereby driving the movable core to move relative to the lower static core, thereby realizing the adjustment of the first and the second magnetic field air gap.

The trip lever comprises a trip lever bump, and the rocker arm assembly comprises an inclined surface matched with the trip lever bump, so that the linear motion of the trip lever drives the rotation of the rocker arm assembly.

The magnetic field air gap adjusting assembly also includes a magnetic setting knob; a rack structure is arranged on the outer surface of the trip lever; a gear structure is arranged at one end of the magnetic setting knob, and the gear structure is engaged with the rack structure, so that the rotational motion of the magnetic setting knob is converted into the linear motion of the trip lever.

The trip lever is provided with a trip lever through hole; a trip lever shaft is accommodated in the trip lever through hole, and the trip lever can rotate around the trip lever shaft and move linearly along the trip lever shaft.

The rocker arm assembly comprises a rocker arm, which can rotate around a rocker arm rotation shaft and connect with the movable core; and a rocker arm positioning plate, which can also rotate around the rocker arm rotation shaft, and the inclined surface is positioned on the rocker arm positioning plate. The magnetic field air gap adjusting assembly also comprises a magnetic adjusting screw; a threaded through hole is arranged on the rocker arm positioning plate, and the magnetic adjusting screw is engaged with the threaded through hole and acts on the rocker arm, so that the magnetic adjusting screw can be screwed in and out of the threaded through hole to move the rocker arm around the rocker arm rotation shaft, thereby the first and the second magnetic fields air gap can be adjusted further.

The movable core comprises a movable core rod part extending from the movable core body and a movable core spherical part located at the end of the movable core rod part. The movable core spherical part can slide and rotate in a slot in the rocker arm.

The magnetic adjusting screw is provided with an adjusting tool matching part, which is used to cooperate with an adjusting tool to rotate the magnetic adjusting screw.

Based on a second aspect of the present disclosure, an electromagnetic trip unit is provided, in which the electromagnetic trip unit includes a trip lever, which can rotate around an longitudinal axis of the trip lever, the trip lever comprises a trip lever body and a trip lever arm extending outward from the trip lever body; a rocker arm which is connected to a movable core and can rotate around a rocker arm axis; the rocker arm includes a rocker arm body and a rocker arm knocking part extending from the rocker arm body; and a rocker arm positioning plate, which can also rotate around the rocker arm axis. The electromagnetic trip unit comprises a movable core, an upper static core and a lower static core. The movable core can move relative to the upper static core and the lower static core in the upper static core and the lower static core. A movable core body end of a movable core body of the movable core faces and approaches the lower static core end of the lower static core. When the electromagnetic trip unit is not released, a first magnetic field air gap is formed between the end of the movable core body end and the lower static core end.

The movable core body of the movable core is also provided with a movable core body step. When the electromagnetic trip unit is not released, a second magnetic field air gap is formed between the movable core body step and the lower static core end.

The electromagnetic trip unit also includes a coil, which is arranged around the movable core. When the short circuit current flows through the coil, the movable core moves toward the lower static core under the attraction of the magnetic field, the motion of the movable core drives the rocker arm to rotate, the rotation of the rocker arm causes the rocker arm knocking part to act on the trip lever arm, thereby making the trip lever rotate around the axis of the trip lever to realize the release action of the electromagnetic trip unit. The electromagnetic trip unit also includes a magnetic field air gap adjustment assembly, the magnetic field air gap adjustment assembly includes the trip lever, a component that causes the trip lever to move along the axis of the trip lever, and the trip lever comprises a trip lever bump, and the rocker arm positioning plate comprises an inclined surface matched with the trip lever bump, so that the linear motion of the trip lever drives the rotation of the rocker arm positioning plate; and a magnetic adjusting screw, wherein a threaded through hole is arranged on the rocker arm positioning plate, and the magnetic adjusting screw is engaged in the threaded through hole and connected with the rocker arm, so that when the linear motion of the trip lever causes the rotation of the rocker arm positioning plate, the rocker arm also follows the said rocker arm positioning plate to rotate, so as to drive the movable core to move relative to the lower static core, thus realizing the adjustment of the air gap of the first and second magnetic fields. The magnetic adjusting screw can be screwed in and out of the threaded through hole to move the rocker arm around the rocker arm rotation shaft, thereby the air gap of the first and second magnetic fields can be further adjusted.

The first magnetic field air gap is smaller than the second magnetic field air gap.

The electromagnetic trip unit also includes a magnetic setting knob. A rack structure is arranged on the outer surface of the trip lever. A gear structure is arranged at one end of the magnetic setting knob. The gear structure is matched with the rack structure, so that the rotational motion of the magnetic setting knob is converted into the linear motion of the trip lever.

The trip lever is provided with a trip lever through hole in which the trip lever shaft is accommodated. The trip lever can rotate around the trip lever shaft and move linearly along the trip lever shaft.

A rocker arm body of the rocker arm comprises a first rocker arm part, a second rocker arm part and a third rocker arm part. The first rocker arm part is provided with a rocker arm through hole and the rocker arm knocking part, and the rocker arm rotation shaft passes through the rocker arm through hole. The rocker arm knocking part is arranged on one end of the first rocker arm part. The second rocker arm part is arranged on the other end of the first rocker arm part, and the second rocker arm part is basically perpendicular to the first rocker arm part; the second rocker arm part is provided with a second rocker arm hollow part in form of slender along its length with a circular section, and the second rocker arm hollow part is provided with a hollow part opening along its length. The third rocker arm portion is arranged at the junction of the first rocker arm portion and the second rocker arm portion, the magnetic adjusting screw passing through the threaded through hole acts on the third rocker arm portion. The rocker arm can rotate around the rocker arm rotation shaft under the pulling of the movable core, and then the rocker arm knocking part knocks the trip lever arm.

The rocker arm positioning plate comprises a first positioning plate portion, a second positioning plate portion and a third positioning plate portion connected with the first positioning plate portion through the second positioning plate portion. The first positioning plate portion is provided with a first rocker arm notch; the rocker arm knocking part of the first rocker arm part passes through the first rocker arm notch and can move in the first rocker arm notch and is limited by the first rocker arm notch. The first positioning plate portion is also provided with an arch space in which a portion of the first rocker arm part and the rocker arm rotation shaft are contained, and the first positioning plate portion can rotate around the rocker arm rotation shaft. The second positioning plate portion is provided with a positioning plate slope surface and a second rocker arm notch. The second rocker arm part can move into the second rocker arm notch and is limited by the second rocker arm notch. The threaded through hole is arranged on the third positioning plate part.

The movable core comprises a movable core rod part, a movable core spherical part and a movable core tail part. The movable core rod part extends from the movable core body. The movable core body is arranged between the movable core spherical part and the movable core tail part. The movable core spherical part can slide and fit in the second rocker arm hollow part. The movable core rod part can slide and fit in the hollow part opening. The opening size of the hollow part opening is set to be smaller than the diameter of the movable core spherical part.

The magnetic adjusting screw is provided with an adjusting tool matching part, which is used to cooperate with an adjusting tool to rotate the magnetic adjusting screw.

The electromagnetic trip unit also comprises a coil bracket, a base, a coil insulating sleeve and a coil upper plate, in which a space formed by the coil bracket and the coil upper plate accommodates the coil insulating sleeve and the coil. The coil is spirally wound on the outer surface of the coil insulating sleeve and the base supports the coil bracket.

The upper static core and the lower static core are contained in the coil insulation sleeve. The movable core tail part of the movable core is connected with a magnetic spring which is contained in the lower static core.

Following, the working principle of the present disclosure is described based on the above-mentioned structure.

According to the disclosure, the instantaneous short-circuit current release condition of the electromagnetic trip unit is that the magnetic field force generated by the current flowing through the coil is greater than the resistance of the magnetic spring, wherein the factors affecting the magnetic field force are: the magnitude of the current (proportional relationship, i.e., the larger the current flowing through the coil, the greater the magnetic field force) and the magnetic field air gap (inverse relationship, i.e., the smaller the magnetic field air gap, the greater the magnetic field force).

In the same distance of magnetic field gap change, the resistance of magnetic spring is much smaller than that of magnetic field force change. In order to adjust the instantaneous setting current value, it is necessary to adjust the magnetic field air gap, and the larger the current, the larger the magnetic field gap.

The magnetic field air gap is determined by the position of the movable core (the position of the movable core determines the size of the magnetic field air gap between the end of the movable core and the end of the lower static core). The position of the movable core is determined by the rotation angle of the rocker arm around the rotation shaft of the rocker arm, the rotation angle of the rocker arm is determined by the position of the magnetic adjusting screw, and the position of the magnetic adjusting screw is determined by the following two aspects:

1) The number of turns in which the magnetic adjusting screw itself rotates in the rocker arm positioning plate. This can be adjusted automatically in the factory when magnetic adjustment is carried out.

2) When the trip lever moves along the trip lever shaft, the trip lever bump contacts the inclined surface of the positioning plate and moves thereon, thereby rotating the rocker arm positioning plate. This rotation allows the customer to turn the magnetic tuning knob to obtain the magnetic setting required by the customer.

Thus, based on the above structure of the present disclosure, the magnetic adjustment screw need not be set on the trip lever. In addition, the number of turns of the magnetic adjustment screw itself in the rocker positioning plate can be automatically adjusted when magnetically adjusted in the factory.

Finally, based on the above-mentioned structure of the present disclosure, the first gravitational magnetic field has a larger gravitational force based on a smaller first magnetic field air gap, which ensures that the movable core starts to move downward in the case of a small current. When the movable core enters the lower static core, the first gravitational magnetic field disappears, and the second gravitational field based on the larger second magnetic field air gap provides the gravitational force to continue moving until the movable core pulls the rocker arm to the release position.

So far, in order to better understand the detailed description of the disclosure herein and to better recognize the contribution of the disclosure to the existing technology, the disclosure has quite extensively outlined the content of the disclosure. Of course, embodiments of the present disclosure will be described below and will form the subject of the appended claims.

Similarly, those skilled in the art will recognize that the concepts on which the disclosure is based can easily be used as a basis for designing other structures, methods and systems for several purposes of implementing the contents of the disclosure. Therefore, it is important that the appended claims should be considered to include such equivalent structures as long as they do not exceed the substance and scope of the present disclosure.

DESCRIPTION OF DRAWINGS

Through the following drawings, those skilled in the art will have a better understanding of the disclosure and better reflect the advantages of the disclosure. The accompanying drawings described herein are for illustrative purposes only of the selected embodiments, not all possible embodiments, and are intended not to limit the scope of the present disclosure.

EMBODIMENTS

Following is a detailed description of the embodiments of the present disclosure in conjunction with the above-mentioned drawings.

Figure 1:
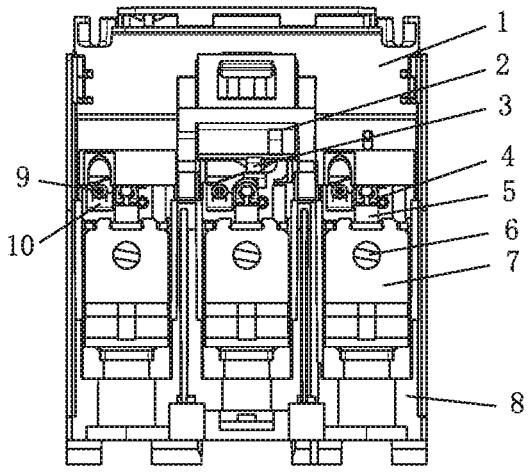
FIG. 1 shows an elevation view with an electromagnetic trip unit according to the present disclosure.

FIG. 1 shows a front view of an electromagnetic trip unit according to the disclosure, in which an electromagnetic trip unit includes an upper cover 1, a trip hammer 2, a trip lever 3, a rocker arm 4, a movable core 5, a coil 6, a coil bracket 7, a base 8, a magnetic adjustment screw 9 and a rocker arm positioning plate 10.

Figure 2:
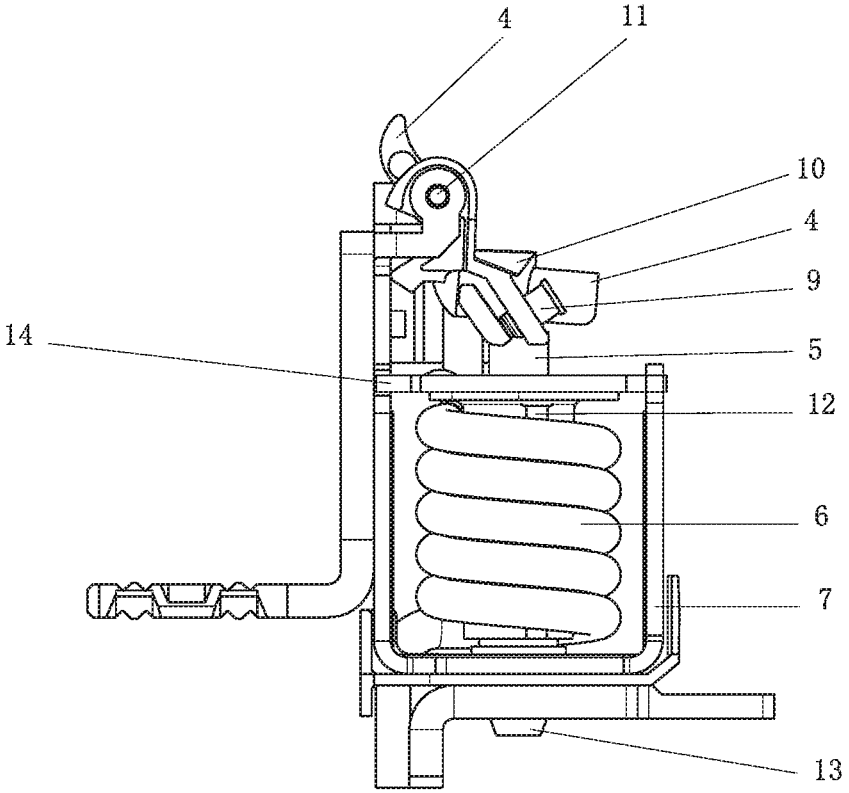
FIG. 2 shows the coils and the magnetic field air gap adjusting assembly contained in the coil bracket according to the present disclosure.
Figure 4:
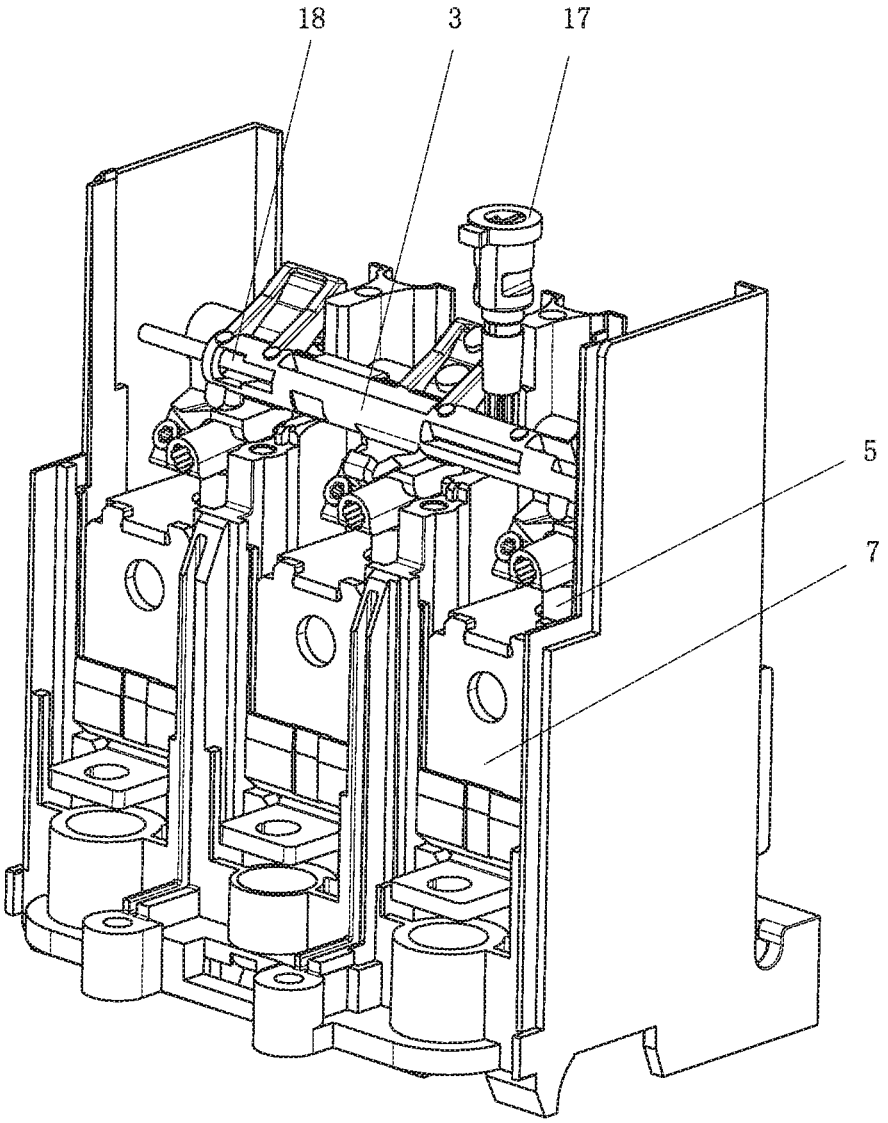
FIG. 4 shows a magnetic setting knob and a trip lever shaft according to the present disclosure.

FIG. 2 shows the coil 6 and a magnetic field air gap adjusting assembly contained in the coil bracket 7 according to the disclosure, wherein the magnetic field air gap adjusting assembly includes the trip lever 3, a rocker arm assembly including the rocker arm 4 and the rocker arm positioning plate 10, the magnetic adjustment screw 9 (also shown in FIG. 8) and a magnetic setting knob 17 (see FIG. 4).

Figure 3:
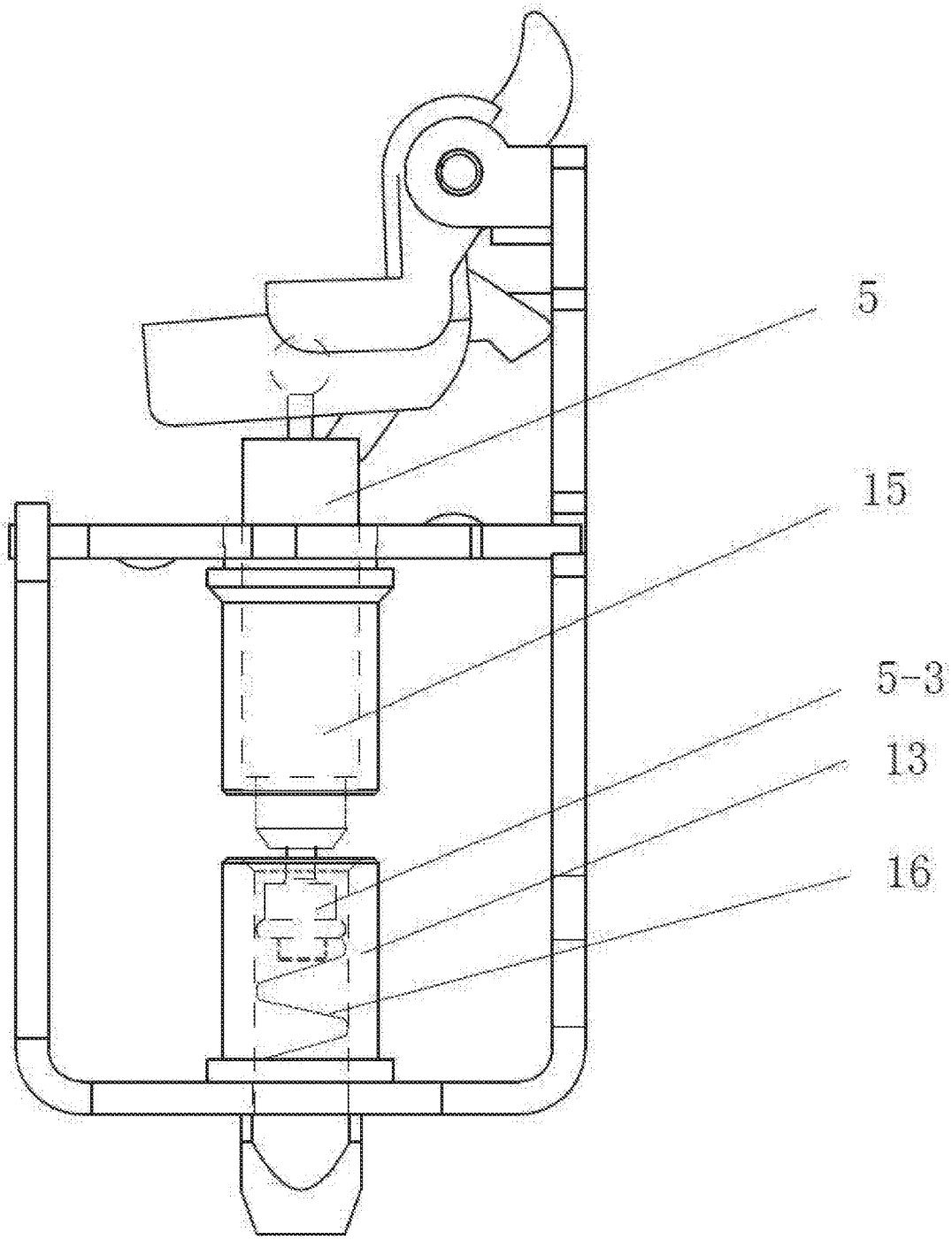
FIG. 3 shows the assembly relationship between the movable core, the upper and lower static core and the magnetic spring according to the present disclosure.

FIG. 3 illustrates the assembly relationship between the movable core 5, the upper static core 15, the lower static core 13 and the magnetic spring 16 according to the disclosure, wherein the movable core 5 can move relative to the upper static core 15 and the lower static core 13 in the said upper static core 15 and the said lower static core 13.

As shown in FIG. 2, the electromagnetic trip unit also includes a coil insulating sleeve 12 and a coil upper plate 14, in which a space formed by the coil bracket 7 and the coil upper plate 14 contains the coil insulating sleeve 12 and the coil 6. The movable core 5 is connected with the magnetic field air gap adjusting assembly by passing through the coil upper plate 14, and the coil 6 is spirally wound around on the external surface of the coil insulating sleeve 12. The base 8 (see FIG. 1) supports the coil bracket 7.

According to FIGS. 2 and 3, the upper static core 15 and the lower static core 13 are contained in the coil insulation sleeve 12 (not shown in FIG. 3), and a movable core tail 5-3 of the movable core 5 is connected with the magnetic spring 16 contained in the lower static core 13.

FIG. 4 shows the trip lever 3, the magnetic setting knob 17 and a trip lever shaft 18 according to the disclosure, in which the trip lever 3 driven by the magnetic setting knob 17 can move along the trip lever shaft 18. Please refer to the description below in conjunction with FIG. 7.

Figure 6:
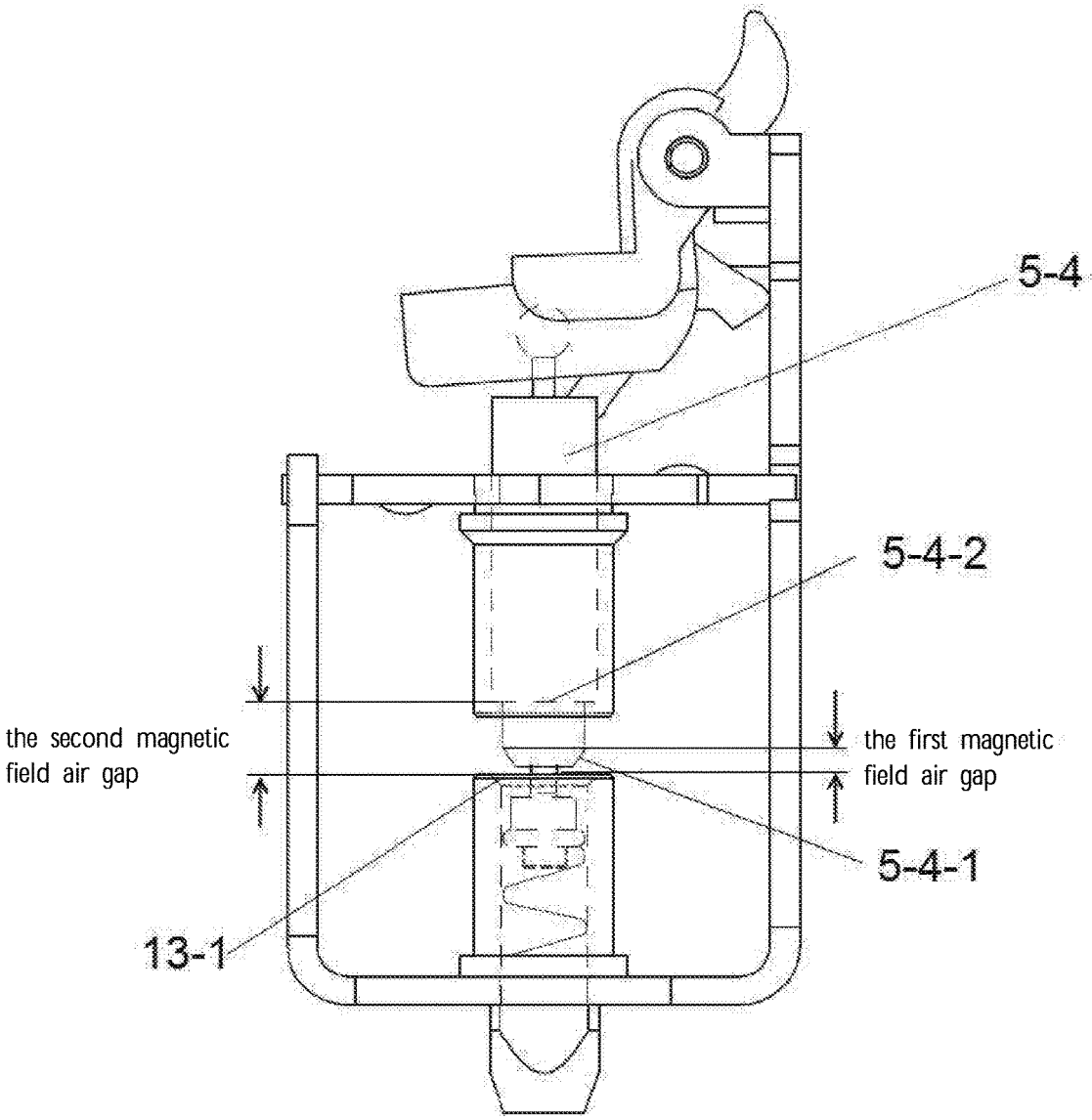
FIG. 6 shows the first and second magnetic field air gaps according to the present disclosure.

FIG. 6 shows the definition of a first and second magnetic field air gap according to the disclosure, wherein the movable core body end 5-4-1 of the movable core body 5-4 of the movable core 5 faces and approaches the lower static core end 13-1 of the lower static core 13. When the electromagnetic trip unit is not released (tripped), the first magnetic field air gap is formed between the movable core body end 5-4-1 and the lower static core end 13-1. The movable core body 5-4 of the movable core 5 is also provided with a movable core body step 5-4-2. When the electromagnetic trip unit is not released, a second magnetic field air gap is formed between the movable core body step 5-4-2 and the lower static core end 13-1.

The first magnetic field air gap is smaller than the second magnetic field air gap.

Figure 7:
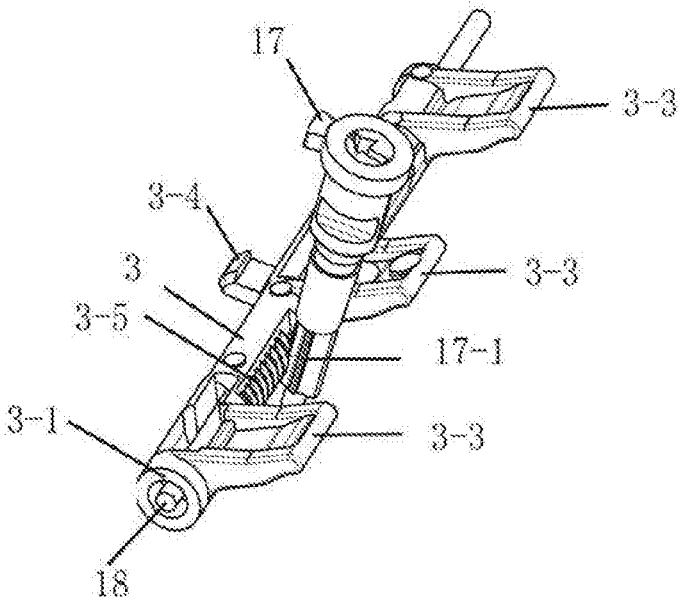
FIG. 7 shows a trip lever and a magnetic setting knob according to the present disclosure, in which a rack-and-pinion fit is formed between the trip lever and the magnetic setting knob.

FIG. 7 shows the trip lever 3 and the magnetic setting knob 17 according to the present disclosure. The trip lever 3 is provided with a trip lever through hole 3-1, a trip lever bump 3-2 (see FIG. 12), a trip lever arm 3-3 and a trip lever hook 3-4. FIG. 7 shows three trip lever arms 3-3 extending outward from the lever body of the trip lever 3 and one trip lever hook 3-4, wherein three trip lever arms 3-3 are distributed equidistantly along the lever body of the trip lever 3.

The through hole 3-1 of the trip lever 3 contains a trip lever shaft 18. The trip lever can rotate around the trip lever shaft 18 and move along the trip lever shaft 18.

A rack structure 3-5 is arranged on the outer peripheral surface of the trip lever 3.

A gear structure 17-1 is arranged at one end of the magnetic setting knob 17, and the gear structure 17-1 is engaged with the rack structure 3-5, so that the rotational motion of the magnetic setting knob 17 is transformed into the linear motion of the trip lever 3 along the trip lever shaft 18. The other end of the magnetic setting knob 17 is provided with a magnetic setting knob adjustment structure, which is used to rotate magnetic setting knob 17 by an adjustment tool. In FIG. 7, the magnetic setting knob 17 is arranged on the right side of the trip lever 3. However, the magnetic setting knob 17 can also be arranged on the left side of the trip lever 3 as required.

Figure 8:
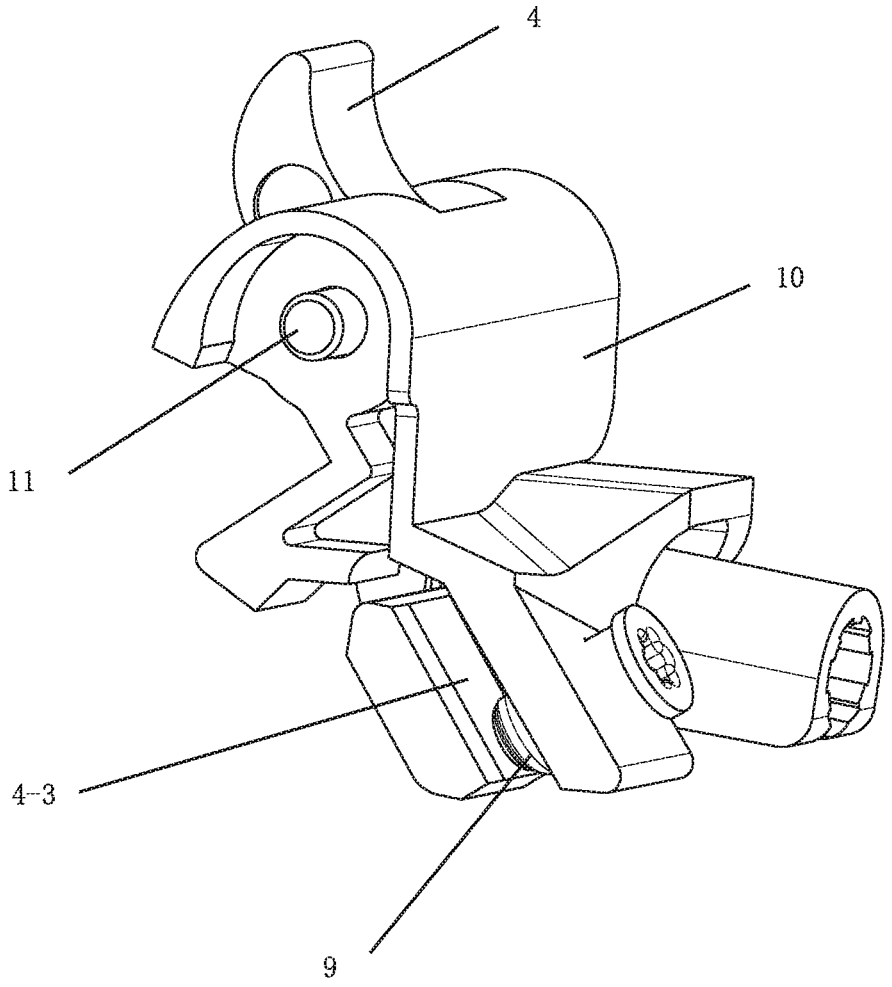
FIG. 8 shows a rocker arm, a rocker arm positioning plate and a magnetic adjusting screw in a magnetic field air gap adjusting assembly according to the present disclosure.

FIG. 8 shows the rocker arm 4, the rocker arm positioning plate 10, and the magnetic adjusting screw 9 in the magnetic field air gap adjusting assembly according to the disclosure, and also shows a rocker arm rotation shaft 11.

Figure 9:
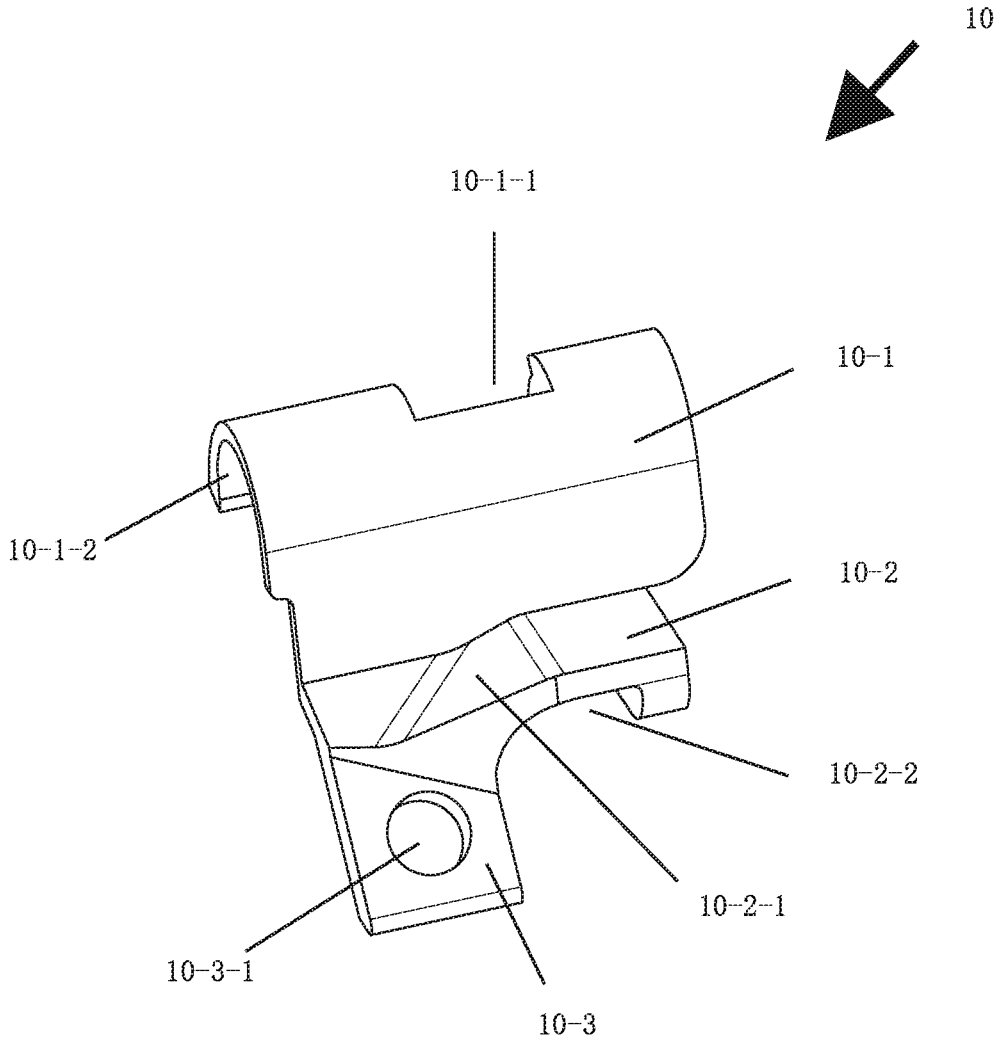
FIG. 9 illustrates a rocker arm positioning plate according to the present disclosure.

FIG. 9 shows a rocker arm positioning plate 10 according to the present disclosure, which comprises a first positioning plate portion 10-1, a second positioning plate portion 10-2 and a third positioning plate portion 10-3 connected with the first positioning plate portion 10-1 via the second positioning plate portion 10-2.

The first positioning plate portion 10-1 is provided with a first rocker arm notch 10-1-1.

The first positioning plate portion 10-1 is also provided with an arch space 10-1-2.

The second positioning plate portion 10-2 is provided with a positioning plate inclined surface 10-2-1 and a second rocker arm notch 10-2-2.

The threaded through hole 10-3-1 is arranged on the third positioning plate part 10-3.

Figure 10:
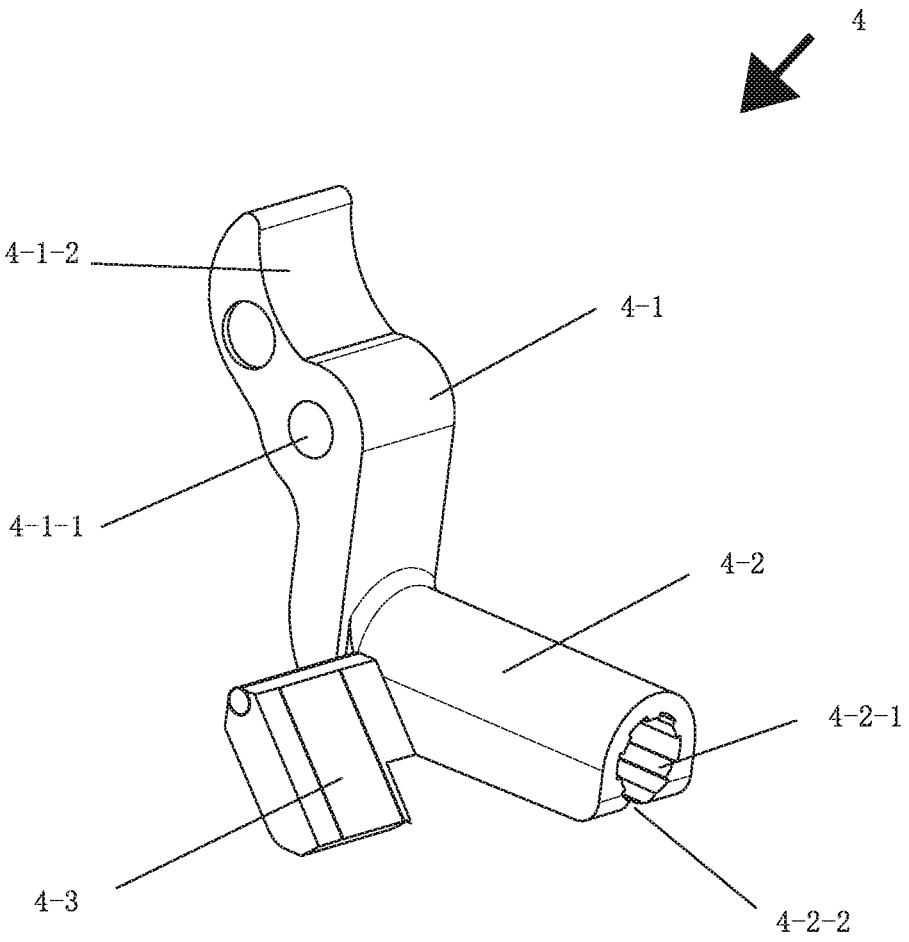
FIG. 10 shows a rocker arm according to the present disclosure.

FIG. 10 shows the rocker arm 4 according to the disclosure, which includes the first rocker arm part 4-1, the second rocker arm part 4-2 and the third rocker arm part 4-3.

The first rocker arm part 4-1 is provided with a rocker arm through hole 4-1-1 and a rocker arm knocking part 4-1-2. The rocker arm rotation shaft 11 passes through the rocker arm through hole 4-1-1.

The rocker arm knocking part 4-1-2 is arranged on one end of the first rocker arm part 4-1.

The second rocker arm part 4-2 is arranged on the other end of the first rocker arm part 4-1, and the second rocker arm part 4-2 is substantially perpendicular to the first rocker arm part 4-1. The second rocker arm part 4-2 is provided along its length with an elongated, circular cross section of second rocker arm hollow portion 4-2-1. The second rocker arm hollow part 4-2-1 is provided with a hollow part opening 4-2-2 along its length.

The third rocker arm part 4-3 is arranged at the joint of the first rocker arm part 4-1 and the second rocker arm part 4-2. The magnetic adjusting screw 9 acts on the third rocker arm part 4-3 by passing through of the threaded through hole 10-3-1.

According to FIGS. 8 to 10, it can be seen that the rocker arm knocking part 4-1-2 of the first rocker arm part 4-1 passes through the first rocker arm notch 10-1-1 and can move in the first rocker arm notch 10-1-1 and is limited by the first rocker arm notch 10-1-1. The second rocker arm part 4-2 can move to the second rocker arm notch 10-2-2 and is limited by the second rocker arm notch 10-2-2. The arch space 10-1-2 contains a part of the first rocker arm part 4-1 and the rocker arm rotation shaft 11 therein. The first positioning plate portion 10-1 can rotate around the rocker arm rotation shaft 11.

The magnetic adjusting screw 9 is engaged in the threaded through hole and acts on the third rocker arm part 4-3 of the rocker arm 4, so that the rotation of the magnetic adjusting screw 9 in the threaded through hole drives the rocker arm 4 to rotate around the rocker arm rotation shaft 11.

Figure 11:
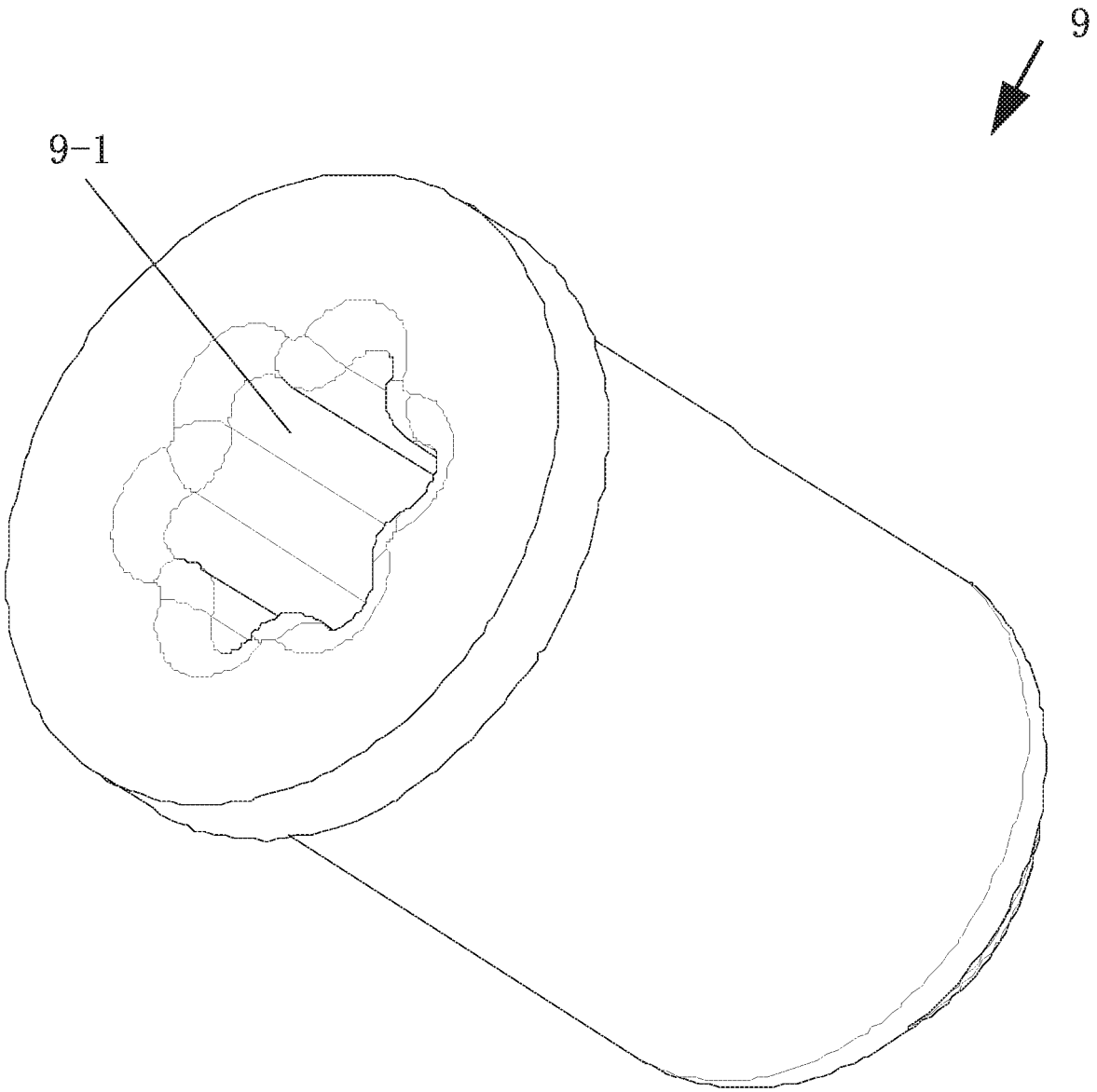
FIG. 11 shows a magnetic adjusting screw according to the present disclosure.

FIG. 11 shows the magnetic adjusting screw according to the disclosure, wherein the magnetic adjusting screw 9 is provided with an adjusting tool matching part 9-1 for matching with an adjusting tool to rotate the magnetic adjusting screw 9 in the threaded through hole 10-3-1.

Figure 12:
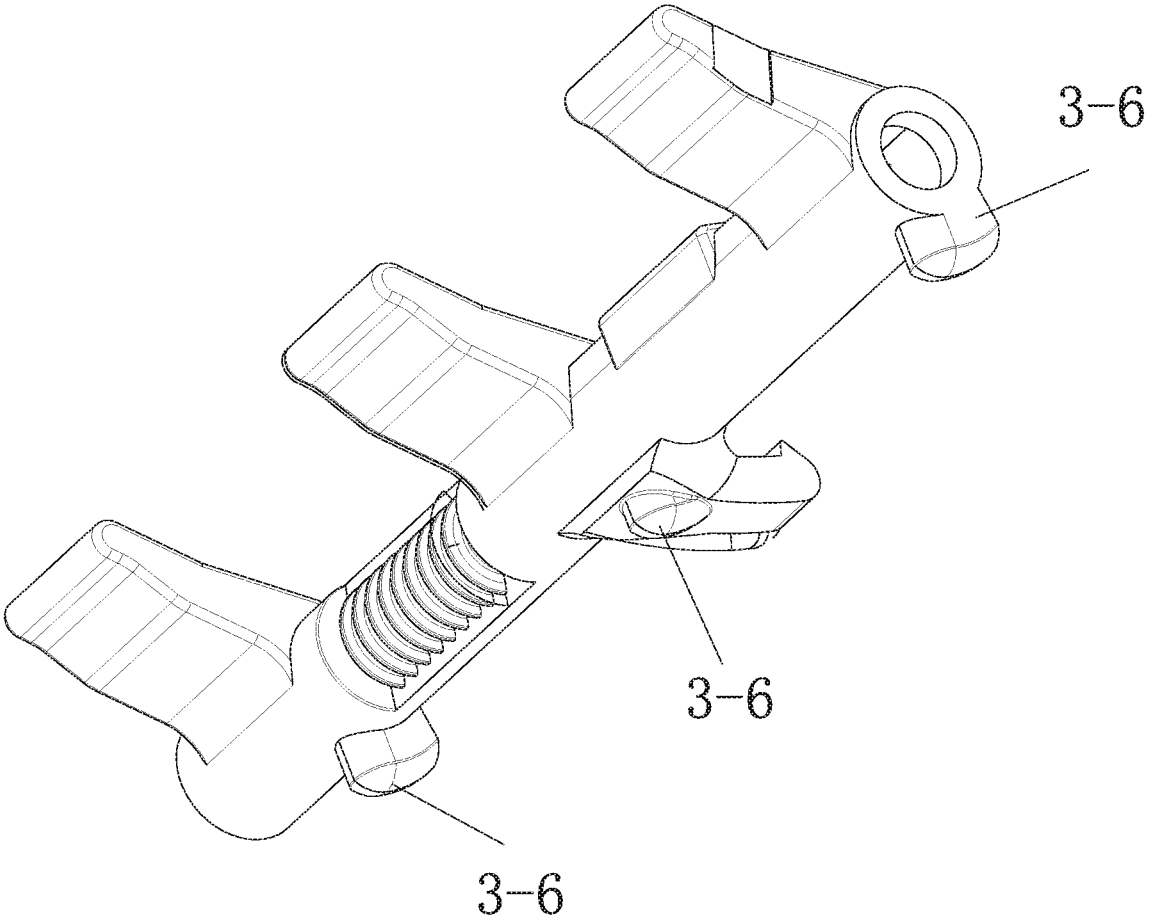
FIG. 12 illustrates a trip lever according to the present disclosure.

Similar with FIG. 7, FIG. 12 shows the trip lever according to the present disclosure. The trip lever 3 is also provided with a trip lever bump 3-6. When the trip lever 3 moves along the trip lever shaft 18, the trip lever bump 3-6 contacts with and moves on the inclined surface of the positioning plate 10-2-1, thereby causing the rocker arm positioning plate 10 to rotate around the rocker arm rotation shaft 11.

Figure 13:
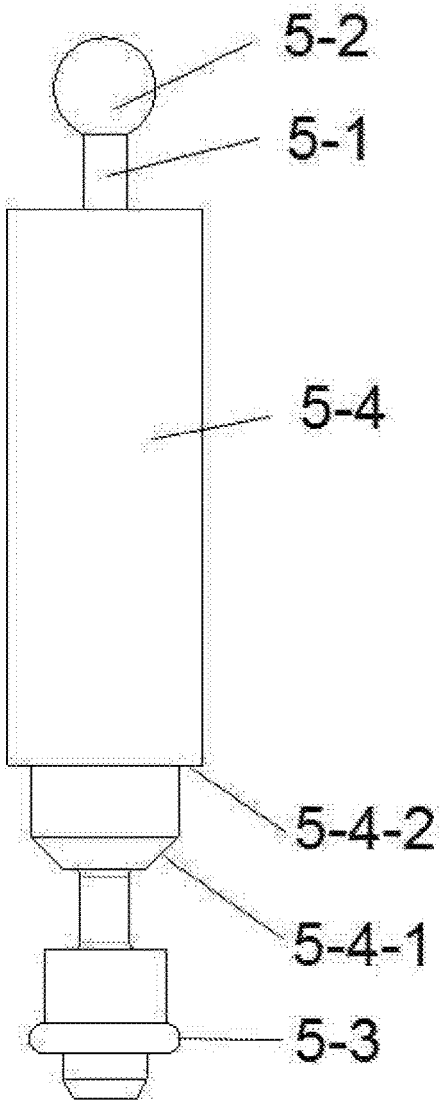
FIG. 13 shows a movable core according to the present disclosure.

FIG. 13 shows the movable core 5 according to the disclosure, which includes a movable core rod part 5-1, a movable core spherical part 5-2, a movable core tail 5-3 and a movable core body 5-4.

The movable core rod part 5-1 extends from the movable core body 5-4. The spherical part 5-2 of the movable core 5 is located at one end of the movable core rod part 5-1. The movable core tail 5-3 is located at the other end of the movable core rod part 5-1.

The movable core body 5-4 is arranged between the spherical part 5-2 and the movable core tail 5-3 of the movable core 5.

Figure 14:
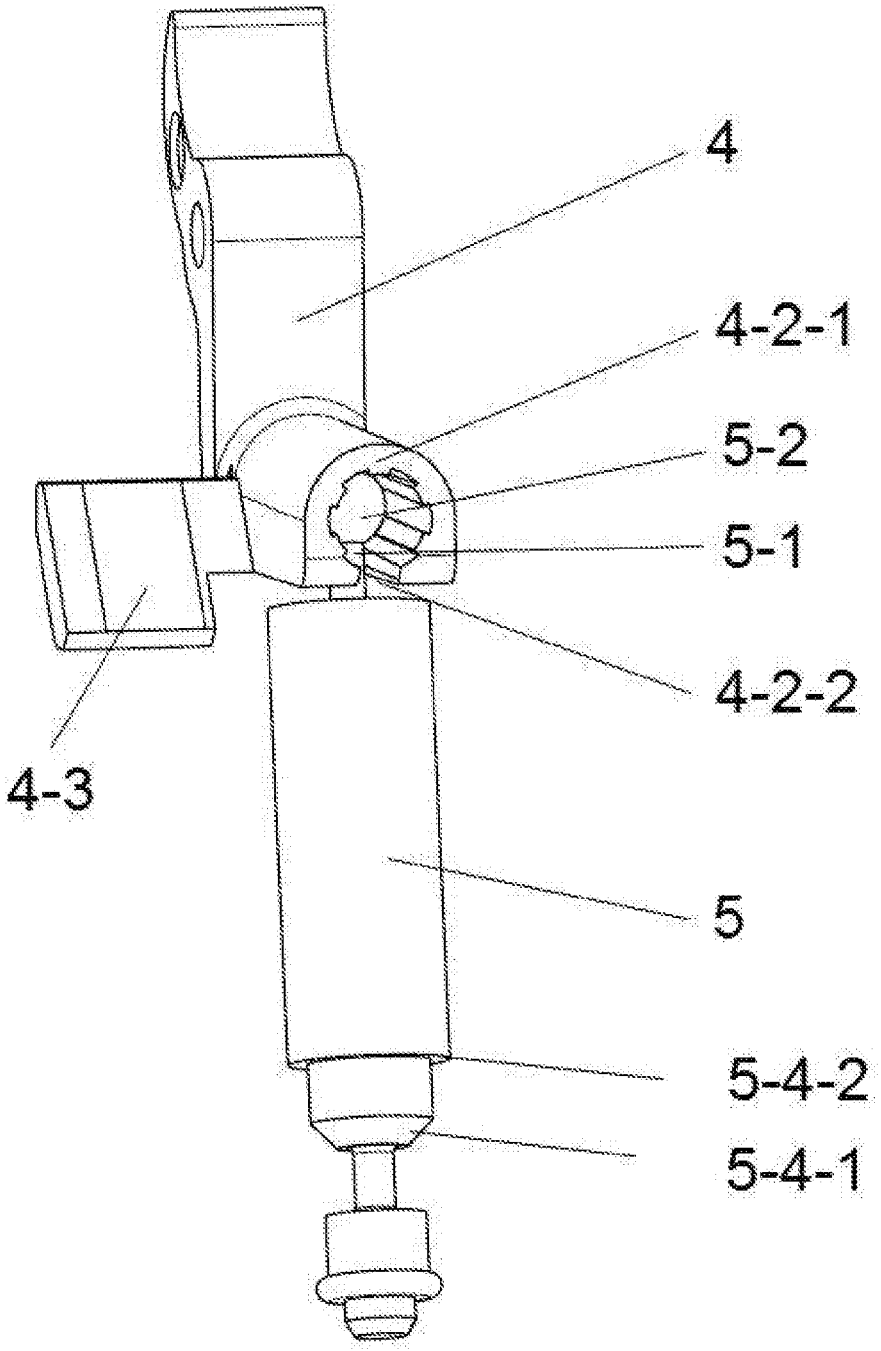
FIG. 14 shows an assembly diagram of a movable core and a rocker arm according to the present disclosure.

FIG. 14 shows an assembly diagram of the movable core 5 and the rocker arm 4 according to the disclosure, wherein the spherical part 5-2 of the movable core 5 can slide-fit in the second rocker arm hollow part 4-2-1 of the rocker arm 4.

The movable core rod part 5-1 is slidably fitted in the hollow part opening 4-2-2.

The opening size of the hollow part opening 4-2-2 is set to be smaller than the diameter of the movable core spherical part 5-2. With the sliding-fit of the spherical part 5-2 of the movable core 5 with the second rocker arm hollow part 4-2-1 of the second rocker arm 4, the rotation of the rocker arm 4 will drive the up and down motion of the movable core 5.

Figure 5:
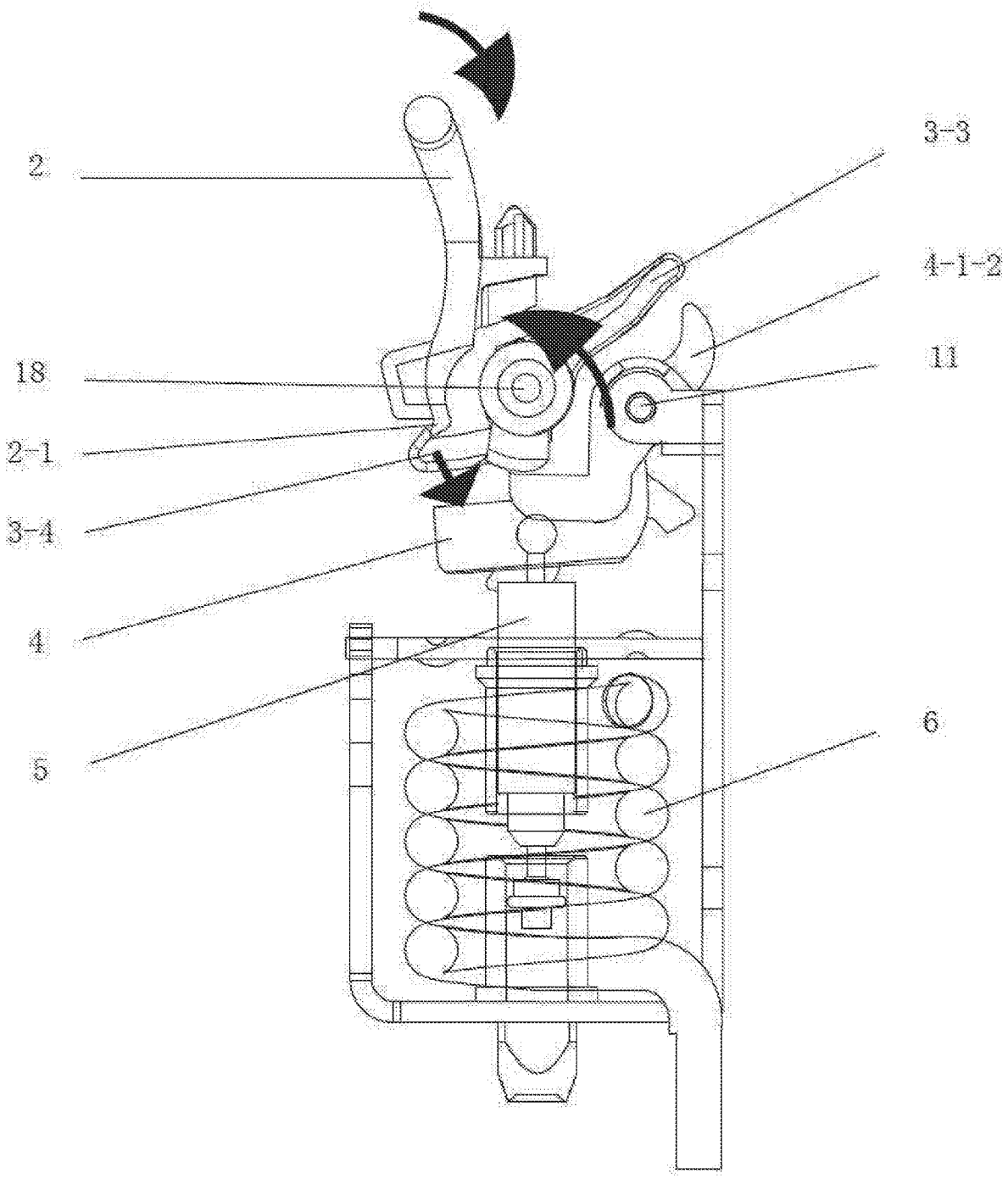
FIG. 5 shows the motion relationship between the movable core, the magnetic field air gap adjusting assembly and the trip lever according to the present disclosure.

The following is a description of the release action of the electromagnetic trip unit with reference to FIG. 5. FIG. 5 shows the motion relationship between the movable core 5, the magnetic field air gap adjusting assembly and the trip lever according to the present disclosure. FIG. 5 also shows that the electromagnetic trip unit further includes the trip hammer 2, which includes a trip hammer spring (not shown) and a trip hammer hook portion 2-1.

The trip hammer hook portion 2-1 is engaged with the trip lever hook 3-4 to prevent the trip hammer 2 from rotating under the action of the trip hammer spring.

The trip hammer hook portion 2-1 and the trip lever hook 3-4 are combined to prevent the trip hammer 2 from rotating under the action of the trip hammer spring (not shown).

With continued reference to FIG. 5, when a short-circuit current flows through the coil 6, the movable core 5 moves toward the lower static core 13 against the resistance of the magnetic spring 16 under the attraction of a magnetic field force (as indicated by the arrow in the figure, the movable core 5 is moved downward). And then, the rocker arm 4 rotates around the rocker rotation shaft 11 under the pulling of the movable core 5 (as shown by the arrow in the figure, the rocker arm 4 rotates in counterclockwise), and the rocker arm knocking part 4-1-2 impacts the trip lever arm 3-3. The trip lever 3 rotates around the trip lever shaft 18 under the impact of the rocker arm 4 (as shown by the arrow in the figure, the trip lever 3 rotates counterclockwise), thereby releasing the snap-fit between the trip hammer hook portion 2-1 and the trip lever hook 3-4. The trip hammer 2 rotates relative to the upper cover 1 of the electromagnetic trip unit under the action of the trip hammer spring (as shown by the arrow in the figure, the trip hammer 2 rotates clockwise) to complete the release action of the electromagnetic trip unit.

Based on the above structure, it can be seen that the electromagnetic trip unit according to the disclosure includes a trip lever and a magnetic field air gap adjusting assembly, wherein the trip lever can move relative to the magnetic field air gap adjusting assembly and actuate the magnetic field air gap adjusting assembly. The magnetic field air gap adjusting assembly is connected with the movable core 5, so that the action of the magnetic field air gap adjusting assembly drives the movable core 5 to adjust the first and second magnetic field air gap.

Specifically, the magnetic field air gap in the disclosure is determined by the position of the movable core 5 (the position of the movable core 5 determines the size of the first magnetic field air gap between the movable core body end 5-4-1 and the lower static core end 13-1 and the size of the second magnetic field air gap between the movable core body step 5-4-2 and the lower static core end 13-1). The position of the movable core 5 is determined by the rotation angle of the rocker arm 4 around the rocker arm rotation shaft 11. The rotation angle of rocker arm 4 is determined by the position of magnetic adjusting screw 9. The position of magnetic adjusting screw 9 is determined by the following two factors:

1) The number of turns in which the magnetic adjusting screw 9 itself rotates in the rocker arm positioning plate 10. This can be adjusted automatically in the factory when magnetic adjustment is carried out.

2) When the trip lever 3 moves along the trip lever shaft 18, the trip lever bump 3-6 contacts the positioning plate inclined surface and moves thereon, thereby causes the rocker arm positioning plate rotating. This rotation allows the customer to turn the magnetic tuning knob 17 to obtain the magnetic setting required by the customer.

Based on the above configuration of the present disclosure, the attraction force of a first gravitational magnetic field is relatively large based on the smaller first magnetic field air gap, which ensures that in the case of a small current, the movable core 5 starts to move downward.

After the movable core 5 enters the lower static core, when the first gravitational magnetic field disappears, a second gravitational magnetic field based on the larger second magnetic field air gap provides the attraction force for continued motion until the movable core pulls the rocker arm to the tripping position.

Referring to specific embodiments, although the present disclosure has been described in the specification and the drawings, it should be understood that, without departing from the scope of the disclosure as defined in the claims, persons in the technical field may make a variety of changes and a variety of equivalents may replace many of them. Furthermore, the combination and collocation of technical features, elements and/or functions between specific embodiments in this article are clear, so according to these disclosed contents, those in the technical field can appreciate that the technical features, elements and/or functions in embodiments can be combined into another specific embodiment as appropriate, unless the above-mentioned contents are otherwise described. In addition, according to the instruction of the contents of the disclosure, many changes can be made to suit special circumstances or materials without departing from the essence of the contents of the disclosure. Therefore, the present disclosure is not limited to the individual specific embodiments illustrated in the drawings, and the specific embodiments described in the specification as the best embodiments currently envisaged for the implementation of the present disclosure, which is intended to include all embodiments falling within the scope of the above description and the appended claims.

The invention claimed is:

1. An electromagnetic trip unit, wherein:

the electromagnetic trip unit includes a movable core, an upper static core and a lower static core;

the movable core can move relative to the upper static core and the lower static core in the upper static core and the lower static core;

a movable core body end of a movable core body of the movable core faces and approaches the lower static core end of the lower static core, when the electromagnetic trip unit is not released, a first magnetic field air gap is formed between the movable core body end and the lower static core end;

the electromagnetic trip unit also includes a magnetic field air gap adjusting assembly which is connected with the movable core and the movement of the magnetic air gap adjusting assembly causes the movable core to move so as to adjust the first magnetic field air gap;

the movable core body of the movable core is also provided with a movable core body step which causes a portion of the movable core body to have a larger diameter than that of the movable core body end along a moving direction of the movable core, when the electromagnetic trip unit is not released, a second magnetic field air gap is formed between the movable core body step and the lower static core end;

the first magnetic field air gap is smaller than the second magnetic field air gap.

2. The electromagnetic trip unit according to claim 1, wherein:

the magnetic field air gap adjusting assembly includes a trip lever, which can rotate around a longitudinal axis of the trip lever and move along the longitudinal axis of the trip lever, and a rocker arm assembly, which is connected to the movable core and can rotate around an axis of the rocker arm assembly;

the linear motion of the trip lever drives the rotation of the rocker arm assembly, thereby driving the movable core to move relative to the lower static core, thereby realizing the adjustment of the first and the second magnetic field air gap.

3. The electromagnetic trip unit according to claim 2, wherein:

the trip lever includes a trip lever bump, and the rocker arm assembly includes an inclined surface matched with the trip lever bump, so that the linear motion of the trip lever drives the rotation of the rocker arm assembly.

4. The electromagnetic trip unit according to claim 2, wherein:

the magnetic field air gap adjusting assembly also includes a magnetic setting knob;

a rack structure is arranged on the outer surface of the trip lever;

a gear structure is arranged at one end of the magnetic setting knob, and the gear structure is engaged with the rack structure, so that the rotational motion of the magnetic setting knob is converted into the linear motion of the trip lever.

5. The electromagnetic trip unit according to claim 2, wherein:

the trip lever is provided with a trip lever through hole;

a trip lever shaft is accommodated in the trip lever through hole, and the trip lever can rotate around the trip lever shaft and move linearly along the trip lever shaft.

6. The electromagnetic trip unit according to claim 3, wherein:

the rocker arm assembly includes a rocker arm, which can rotate around a rocker arm rotation shaft and connect with the movable core, and a rocker arm positioning plate, which can also rotate around the rocker arm rotation shaft, and the inclined surface is positioned on the rocker arm positioning plate;

the magnetic field air gap adjusting assembly also includes a magnetic adjusting screw;

a threaded through hole is arranged on the rocker arm positioning plate, and the magnetic adjusting screw is engaged with the threaded through hole and acts on the rocker arm, so that the magnetic adjusting screw can be screwed in and out of the threaded through hole to move the rocker arm around the rocker arm rotation shaft, thereby the first and the second magnetic fields air gap can be further adjusted.

7. The electromagnetic trip unit according to claim 6, wherein:

the movable core includes a movable core rod part extending from the movable core body and a movable core spherical part located at the end of the movable core rod part;

the movable core spherical part can slide and rotate in a slot in the rocker arm.

8. The electromagnetic trip unit according to claim 6, wherein:

the magnetic adjusting screw is provided with an adjusting tool matching part, which is used to cooperate with an adjusting tool to rotate the magnetic adjusting screw.

9. An electromagnetic trip unit, in which:

the electromagnetic trip unit includes a trip lever, which can rotate around an longitudinal axis of the trip lever, the trip lever includes a trip lever body and a trip lever arm extending outward from the trip lever body;

a rocker arm is connected to a movable core and can rotate around an axis of the rocker arm; the rocker arm includes a rocker arm body and a rocker arm knocking part extending from the rocker arm body; and a rocker arm positioning plate, which can also rotate around the rocker arm axis;

the electromagnetic trip unit includes the movable core, an upper static core and a lower static core;

the movable core can move relative to the upper static core and the lower static core in the upper static core and the lower static core;

a movable core body end of a movable core body of the movable core faces and approaches the lower static core end of the lower static core, when the electromagnetic trip unit is not released, a first magnetic field air gap is formed between the end of the movable core body end and the lower static core end;

the movable core body of the movable core is also provided with a movable core body step which causes a portion of the movable core body to have a larger diameter than that of the movable core body end along a moving direction of the movable core, when the electromagnetic trip unit is not released, a second magnetic field air gap is formed between the movable core body step and the lower static core end;

the electromagnetic trip unit also includes a coil, which is arranged around the movable core;

when the short circuit current flows through the coil, the movable core moves toward the lower static core under the attraction of the magnetic field, the motion of the movable core drives the rocker arm to rotate, the rotation of the rocker arm causes the rocker arm knocking part to act on the trip lever arm, thereby making the trip lever rotate around the axis of the trip lever to realize the release action of the electromagnetic trip unit;

the electromagnetic trip unit also includes a magnetic field air gap adjustment assembly, the magnetic field air gap adjustment assembly includes the trip lever, a component that causes the trip lever to move along the axis of the trip lever, and the trip lever includes a trip lever bump, and the rocker arm positioning plate includes an inclined surface engaged with the trip lever bump, so that the linear motion of the trip lever drives the rotation of the rocker arm positioning plate; and a magnetic adjusting screw, wherein a threaded through hole is arranged on the rocker arm positioning plate, and the magnetic adjusting screw is engaged in the threaded through hole and connected with the rocker arm, so that when the linear motion of the trip lever causes the rotation of the rocker arm positioning plate, the rocker arm also follows the said rocker arm positioning plate to rotate, so as to drive the movable core to move relative to the lower static core, thus realizing the adjustment of the air gap of the first and second magnetic fields;

the magnetic adjusting screw can be screwed in and out of the threaded through hole to move the rocker arm around the rocker arm rotation shaft, thereby the first and second magnetic fields air gap can be further adjusted;

the first magnetic field air gap is smaller than the second magnetic field air gap.

10. The electromagnetic trip unit according to claim 9, wherein:

the electromagnetic trip unit also includes a magnetic setting knob;

a rack structure is arranged on the outer surface of the trip lever;

a gear structure is arranged at one end of the magnetic setting knob, and the gear structure is matched with the rack structure, so that the rotational motion of the magnetic setting knob is converted into the linear motion of the trip lever.

11. The electromagnetic trip unit according to claim 9, wherein:

the trip lever is provided with a trip lever through hole;

the trip lever shaft is accommodated in the trip lever through hole, and the trip lever can rotate around the trip lever shaft and move linearly along the trip lever shaft.

12. The electromagnetic trip unit according to claim 9, wherein:

a rocker arm body of the rocker arm includes a first rocker arm part, a second rocker arm part and a third rocker arm part;

the first rocker arm part is provided with a rocker arm through hole and the rocker arm knocking part, and the rocker arm rotation shaft passes through the rocker arm through hole;

the rocker arm knocking part is arranged on one end of the first rocker arm part;

the second rocker arm part is arranged on the other end of the first rocker arm part, and the second rocker arm part is basically perpendicular to the first rocker arm part; the second rocker arm part is provided with a second rocker arm hollow part in form of slender along its length with a circular section, and the second rocker arm hollow part is provided with a hollow part opening along its length;

the third rocker arm portion is arranged at the junction of the first rocker arm portion and the second rocker arm portion, the magnetic adjusting screw passing through the threaded through hole acts on the third rocker arm portion;

the rocker arm can rotate around the rocker arm rotation shaft under the pulling of the movable core, and then the rocker arm knocking part impacts the trip lever arm.

13. The electromagnetic trip unit according to claim 12, wherein:

the rocker arm positioning plate includes a first positioning plate portion, a second positioning plate portion and a third positioning plate portion connected with the first positioning plate portion via the second positioning plate portion;

the first positioning plate portion is provided with a first rocker arm notch; the rocker arm knocking part of the first rocker arm part passes through the first rocker arm notch and can move in the first rocker arm notch and is limited by the first rocker arm notch;

the first positioning plate portion is also provided with an arch space in which a portion of the first rocker arm part and the rocker arm rotation shaft are contained, and the first positioning plate portion can rotate around the rocker arm rotation shaft;

the second positioning plate portion is provided with a positioning plate slope surface and a second rocker arm notch, the second rocker arm part can move into the second rocker arm notch and is limited by the second rocker arm notch;

the threaded through hole is arranged on the third positioning plate part.

14. The electromagnetic trip unit according to claim 12, wherein:

the movable core includes a movable core rod part, a movable core spherical part and a movable core tail part;

the movable core rod part extends from the movable core body;

the movable core body is arranged between the movable core spherical part and the movable core tail part;

the movable core spherical part can slide and fit in the second rocker arm hollow part;

the movable core rod part can slide and fit in the hollow part opening;

the opening size of the hollow part opening is set to be smaller than the diameter of the movable core spherical part.

15. The electromagnetic trip unit according to claim 9, wherein:

the magnetic adjusting screw is provided with an adjusting tool matching part, which is used to cooperate with an adjusting tool to rotate the magnetic adjusting screw.

16. The electromagnetic trip unit according to claim 9, wherein:

the electromagnetic trip unit also includes a coil bracket, a base, a coil insulating sleeve and a coil upper plate, in which a space formed by the coil bracket and the coil upper plate accommodates the coil insulating sleeve and the coil, which are spirally wound on the outer surface of the coil insulating sleeve, and the base supports the coil bracket.

17. The electromagnetic trip unit according to claim 14, wherein:

the upper static core and the lower static core are contained in the coil insulation sleeve, and the movable core tail part of the movable core is connected with a magnetic spring contained in the lower static core.

* * * * *